United States Patent [19]

Lamberti

[11] 3,997,698

[45] Dec. 14, 1976

[54] PROCESS OF SIZING FABRICS AND THREADS WITH TRIAMIDES

[75] Inventor: Vincent Lamberti, Upper Saddle River, N.J.

[73] Assignee: Lever Brothers Company, New York, N.Y.

[22] Filed: Nov. 3, 1975

[21] Appl. No.: 628,007

Related U.S. Application Data

[62] Division of Ser. No. 469,492, May 13, 1974, Pat. No. 3,959,373.

[52] U.S. Cl. ..... 428/262; 57/164; 106/210; 252/8.8; 252/51.5 A; 428/264; 428/265; 428/375; 428/392

[51] Int. Cl.[2] ..... B05D 5/08; C08L 3/00; D06M 13/18; D06M 13/40

[58] Field of Search ..... 252/8.8; 106/210; 428/262, 264, 375, 378, 392

[56] References Cited

UNITED STATES PATENTS

| | | | |
|---|---|---|---|
| 3,198,828 | 8/1965 | Matter | 260/561 K |
| 3,580,967 | 5/1971 | Norell | 260/561 K |
| 3,766,269 | 10/1973 | Powell | 260/561 K |
| 3,959,373 | 5/1976 | Lamberti | 260/561 K |

*Primary Examiner*—J.C. Cannon
*Attorney, Agent, or Firm*—Kenneth F. Dusyn; Melvin H. Kurtz; James J. Farrell

[57] ABSTRACT

The triamide, tri(N-alkylamides) and tri(N-alkanolamides) of 2-oxabutane-1,3,4-tricarboxylic acid are novel compounds variously having utility in the fields of (a) corrosion prevention, being particularly useful as anti-corrosion agents in lubricants; (b) sizing of textiles; and (c) lubrication, being particularly useful as lubricants in cutting oils, in textile sizing, in the manufacture of cord, rope, twine, and the like, and as general lubricating compounds.

2 Claims, No Drawings

PROCESS OF SIZING FABRICS AND THREADS WITH TRIAMIDES

This is a division of application Ser. No. 469,492, filed May 13, 1974, now U.S. Pat. No. 3,959,373.

BACKGROUND OF THE INVENTION

1. Field of the Invention

The present invention relates to amide derivatives of 2-oxabutane-1,3,4-tricarboxylic acid (also known as carboxymethyloxysuccinic acid); more particularly the triamide, tri(N-alkylamides) and tri(N-alkanolamides) of 2-oxabutane-1,3,4-tricarboxylic acid. Especially preferred are those embodiments of the present invention wherein the alkyl substituent has from 1 to about 18 carbon atoms. These compounds find use as components of cutting and lubricating oils, as lubricants in the manufacture of fabrics, cord, twine, and the like, and as sizing agents for textiles.

2. Discussion of the Prior Art

N-substituted succinamides and citramides are known for their utility as anti-rust additives for lubricating oil, and as textile finishing agents, respectively. The use of N,N'-didodecyl succinamide as a rust inhibitor in lubricating oil is described in C.A. vol. 61, 4209g. The utility of N,N',N''-tri-(hydroxymethyl)citramide and N,N',N''-trimethyl citramide as textile finishing agents is disclosed in C.A. vol. 53, page 1771C.

A description of processes and equipment for the manufacture and treatment of textile fibers and fabrics may be found in the text "American Cotton Handbook", Second Edition, 1949, Textile Book Publishers.

U.S. Pat. No. 3,733,275 discloses the use of certain fatty amides and N-substituted amides as extreme pressure lubricants.

SUMMARY OF THE INVENTION

The invention herein is the discovery of compounds having the formula:

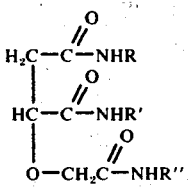

wherein R, R', and R'', which may be the same or different. are selected from the group consisting of:

a. hydrogen, b. straight and branched chain hydrocarbon radicals having from 1 to about 18 carbon atoms, and (c)

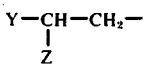

wherein Z is selected from the group consisting of H and OH and when Z is H, Y is OH or $CH_2OH$, and when Z is OH, Y is $CH_3$, and d. combinations of (a), (b), and (c).

The invention herein is also the discovery that compounds within the above formula can be used as components of cutting lubricating oils, as lubricants in the manufacture of fabrics, cord, twine, and the like, and as sizing agents for textiles. The lower molecular weight species, i.e., those having an amide nitrogen atom which is unsubstituted or which has an alkyl substituent with from 1 to about 7 carbon atoms, or an alkanol substituent having about 2 to about 3 carbon atoms are preferred for use as components in cutting and lubricating oils and lubricants for fabrics cord, twine, and the like. Higher molecular weight species, i.e., those having an amido nitrogen atom which bears an alkyl substituent with from about 8 to about 18 carbon atoms are preferred for use as lubricants and as sizing for textiles.

DETAILED DESCRIPTION OF THE INVENTION

The present invention relates to amide derivatives of 2-oxabutane-1,3,4-tricarboxylic acid; more particularly the triamide, tri(N-alkylamides) and tri(N-alkanolamides) of 2-oxabutane-1,3,4-tricarboxylic acid having the formula:

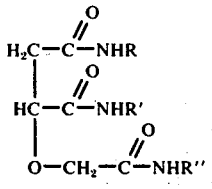

wherein R, R' and R'', which may be the same or different are selected from the group consisting of:

a. hydrogen, b. straight and branched chain hydrocarbon radicals having from 1 to about 18 carbon atoms, and (c)

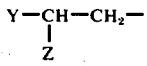

wherein Z is selected from the group consisting of H and OH, and when Z is H, Y is OH or $CH_2OH$, and when Z is OH, Y is $CH_3$, and d. combinations of (a), (b), and (c).

Representation amido compounds falling with the present invention are the following:

| | |
|---|---|
| the triamide | of 2-oxabutane-1,3,4-tricarboxylic acid |
| the tri(N-methylamide) | " |
| the tri(N-ethylamide) | " |
| the tri(N-n-propylamide) | " |
| the tri(N-isopropylamide) | " |
| the tri(N-monoethanolamide) | " |
| the tri(N-propanolamide) | " |
| the tri(N-isopropanolamide) | " |
| the tri(N-butylamide) | " |
| the tri(N-pentylamide) | " |

-continued

| | |
|---|---|
| the tri(N-hexylamide) | " |
| the tri(N-heptylamide) | " |
| the tri(N-octylamide) | " |
| the tri(N-nonylamide) | " |
| the tri(N-decylamide) | " |
| the tri(N-hendecylamide) | " |
| the tri(N-dodecylamide) | " |
| the tri(N-tridecylamide) | " |
| the tri(N-tetradecylamide) | " |
| the tri(N-pentadecylamide) | " |
| the tri(N-hexadecylamide) | " |
| the tri(N-heptadecylamide) | " |
| the tri(N-octadecylamide) | " |

The foregoing nomenclature includes compounds wherein the primary amino group is attached randomly to the alkyl chains in the secondary positions as well as terminally.

The amido compounds of the present invention within the foregoing structure find utility as lubricants for textile fabrics derived from natural and synthetic fibers; cord, rope, twine, yarn, dental floss and the like during the manufacture of these products, and as sizing for textile fabrics. They are also useful as lubricating aids and anti-corrosion agents in cutting oils and lubricating oils.

To obtain greatest effectiveness in a desired area of utility, some selection may be made. For example, the lower molecular weight species of the present invention, i.e., those having an amido nitrogen atom which is unsubstituted or which bears an alkyl substituent having 1 to about 7 carbon atoms, or an alkanol substitutent having 2 or 3 carbon atoms, may be advantageously selected for use in cutting oils, lubricating oils, and as lubricants in the manufacture of textiles, or in the processing of cord, rope, twine, or the like. The ethanolamides, in particular, are useful in cutting and lubricating oil compositions at levels of about 0.5 to about 10%, preferably about 1 to about 5% of the total composition.

The higher molecular weight members, i.e., those wherein the amido nitrogen atom bears an alkyl substituent having about 8 to about 18 carbon atoms may be advantageously selected for use in lubricating oils, and as sizing for textiles, or as lubricants when incorporated into conventional sizing compositions. For example, in a cotton wearing operation, the warp threads, being under tension and subject to breakage, require lubrication. This generally takes the form of sizing, an operation which coats the warp threads with a smooth coat of the sizing substance. Advantageously the sizing substance may be a mixture of starch suitably corn or potato starch, and an amide within the generic structure set forth hereinabove emulsified as an aqueous emulsion. Suitable emulsifiers are soaps, particularly rosin soaps or cottonseed oil soaps, or cationic emulsifying agents. The application of an emulsion of starch and amide at an amide level ranging from about 1 to about 20% simultaneously sizes and lubricates the warp threads.

The amides of the present invention may be prepared by the general process of reacting ammonia or an amine with the trimethyl ester of 2-oxabutane-1,3,4-tricarboxylic acid, separating the resulting amide reaction product, and recrystallizing if required. Details of the preparation, modified to suit the individual species, are set forth in the examples.

Compounds within the invention for which the method of preparation is not specifically set forth, may be prepared by persons skilled in the art in accordance with the teachings herein.

The trimethyl ester of 2-oxabutane-1,3,4-tricarboxylic acid used in the processes described in the examples may be prepared in the following manner.

A weight of 103 gm (0.4 mole) of trisodium 2-oxabutane-1,3,4-tricarboxylate or 0.2 mole of tricalcium bis(2-oxabutane-1,3,4-tricarboxylate) (also known as trisodium carboxymethyloxysuccinate and calcium carboxymethyloxysuccinate, respectively), either of which may be prepared as described in U.S. Pat. No. 3,692,685, assigned to the instant assignee, is mixed with 115 gm (3.6 moles) of methanol, 360 ml of ethylene chloride and 45 ml of concentrated sulfuric acid, and refluxed for 13 hours. The precipitated salts are filtered off and the filtrate washed repeatedly with saturated sodium bicarbonate solution, followed by water until the washings are neutral. The ethylene dichloride layer is then dried over anhydrous sodium sulfate, filtered, and the filtrate subjected to evaporation to remove ethylene chloride, and to provide a residue of ester, which is then distilled in vacuo. The distilled ester is the trimethyl ester of 2-oxabutane-1,3,4-tricarboxylic acid, having a boiling point of 117° C at 0.25 mm mercury pressure.

The invention may be more fully understood by reference to the following Examples, which are to be considered illustrative, but not limitative, of the invention.

EXAMPLE 1

Method for Preparing the triamide of 2-oxabutane-1,3,4-tricarboxylic acid

One-tenth mole (23.4 gm) of the trimethyl ester of 2-oxabutane-1,3,4-tricarboxylic acid (also known as carboxymethyloxysuccinic acid) is placed in a one-pint mason jar. 115 gms of concentrated ammonium hydroxide solution are added, and the liquids shaken for a short time until a clear homogeneous solution is obtained. The solution is allowed to stand for 19 days at room temperature with occasional shaking, during which time amide formation progresses. The amide, insoluble in the ammonium hydroxide solution, is collected on a filter and dried to constant weight. The product does not melt at temperatures up to 200° C, and exhibits slight decompositions at temperatures approaching the 200° C level.

The amide structure is confirmed by infrared analysis.

When the product is crystallized from dimethyl sulfoxide, washed with acetone, and dried in vacuo at 50° C to constant weight, the nitrogen content is 22.8%, compared to the theoretical 22.2%.

EXAMPLE 2

Method for Preparing the tri(N-monoethanolamide) of 2-oxabutane-1,3,4-tricarboxylic acid To 0.3 mole (18.3 gm) of monoethanolamine is added dropwise 0.1 mole (23.4 gm) of the trimethyl ester of 2-oxabutane-1,3,4-tricarboxylic acid with vigorous stirring. During the addition the temperature rises slowly to 65° C, and a pink color develops which changes to a light red on standing. The product is extracted with chloroform to remove unreacted substances, then dissolved in 800 ml of water, treated with 2 grams of carbon adsorbent (Darco, trade mark of Atlas Chemical Industries), then filtered. The filtrate is concentrated on the steam bath and dried in vacuo at 50° C to a tan waxy solid. The compound melts in the range of 79°–97° C. Analysis for nitrogen shows 12.7% N, (theoretical 13.1%.). The structure,

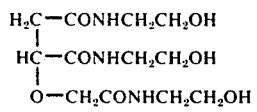

is confirmed by NMR analysis.

EXAMPLE 3

Method for Preparing the tri(N-isopropanolamide) of 2-oxabutane-1,3,4-tricarboxylic acid To 0.3 mole (22.5 gm) of monoisopropanolamine is added dropwise 0.1 mole (23.4 gm) of the trimethyl ester of the 2-oxabutane-1,3,4-tricarboxylic acid with vigorous stirring. The remaining steps of the process are carried out as described in Example 2 for the preparation of the ethanolamide derivative.

EXAMPLE 4

Method for Preparing the tri(N-methylamide) of 2-oxabutane-1,3,4-tricarboxylic acid One-tenth mole (23.4 gm) of the trimethyl ester of 2-oxabutane-1,3,4-tricarboxylic acid is placed in a one-pint mason jar. Fifty grams of a 40% solution of methylamine are added and the liquids shaken by means of a mechanical shaker for one week at room temperature. The amide which has formed is insoluble in the methylamine solution and is collected on a filter, and dried in vacuo at 50° C to constant weight.

EXAMPLE 5

Method for Preparing the tri(N-ethylamide) of 2-oxabutane-1,3,4-tricarboxylic acid One-tenth mole (23.4 gm) of the trimethyl ester of 2-oxabutane-1,3,4-tricarboxylic acid is placed in a one-pint mason jar. Sixty-five grams of a 70% aqueous solution of ethylamine are added and the liquids shaken for a short time until a homogeneous solution is obtained. The solution is allowed to stand for one week during which time the insoluble amide is formed. The amide is filtered off, and dried in vacuo to constant weight.

EXAMPLE 6

Method for Preparing the tri(N-n-propylamide) of 2-oxabutane-1,3,4-tricarboxylic acid To 0.3 mole (17.7 gm) of n-propylamine are added dropwise 0.1 mole (23.4 gm) of the trimethyl ester of 2-oxabutane-1,3,4-tricarboxylic acid with vigorous stirring. During the addition the temperature rises slowly to 37° C. The mixture is held for 4 hours at 45° C with stirring forming a semi-solid product. The product is dissolved in 100 ml acetone, chilled in an ice bath, filtered, and the contents on the filter washed thoroughly with cold acetone, then dried in vacuo to constant weight at 40°–50° C.

EXAMPLE 7

Method for Preparing the tri(N-nonylamide) of 2-oxabutane-1,3,4-tricarboxylic acid To 0.3 mole (43 gm) of n-nonylamine is added dropwise 0.1 mole (23.4 gm) of the trimethyl ester of 2-oxabutane-1,3,4-tricarboxylic acid while stirring the mixture vigorously. The temperature rises gradually to about 40° C and the mixture is then heated at 90°–95° C for 5 hours using a water bath. The reaction product is recrystallized once from 600 cc of acetone and once from a mixture of 600 cc of acetone and 50 cc of ethanol. The product is then filtered, washed with fresh acetone and dried; m.p. 111.6°–113.1°C. The amide structure is confirmed by infrared analysis.

EXAMPLE 8

Method for Preparing the tri($C_{14}$–$C_{15}$ alkylamide) of 2-oxabutane-1,3,4-tricarboxylic acid The amine used in the method described below is a mixture of alkyl primary amines having a chain length distribution of 0.3% $C_{10}$, 0.5% $C_{11}$, 0.5% $C_{12}$, 3.3% $C_{13}$, 61.9% $C_{14}$, 27.4% $C_{15}$, and 6.1% $C_{16}$ and higher chain lengths, and a boiling point of 212°–286° F at 14 mm mercury. The amino groups are positioned randomly along the alkyl carbon chains in the secondary positions. A sample of this amine, 33 gm. (0.15 mole) is added dropwise to 12 gm (0.05 mole) of trimethyl 2-oxabutane-1,3,4-tricarboxylate and the mixture heated at 75°–80° C for 5 hours followed by an additional 5 hours at 130° C. A sample of the crude reaction product, 32.5 gm, dissolved in methanol is then treated with 76 ml of Bio Rad Ag 50 W-X8 cation exchange resin (acid cycle) which has been substantially dried by pre-washing with methanol. The resin/methanol/crude amide mixture is stirred for 24 hours and is then filtered. The filtrate is evaporated on the steam bath to yield the purified amide which is a dark amber liquid. Infrared analysis confirms the amide structure and absence of ester starting material.

EXAMPLE 9

Method for Preparing the tri(N-butylamide) 2-oxabutane-1,3,4-tricarboxylic acid

To 0.3 mole (22 gm) of n-butylamine are added dropwise 0.1 mole (23.4 gm) of 2-oxyabutane-1,3,4-tricarboxylic acid with vigourous stirring. During the addition, the temperature rises slowly to 40° C. The mixture is held 4 hours at 50° C with stirring, forming a semi-solid product. The product is dissolved in 120 ml of acetone, chilled in an ice bath, filtered, and the contents on the filter washed thoroughly with cold acetone, then dried in vacuo to constant weight. The dry products melts at 106.5°–107.5° C and has a nitrogen content of 11.8% (theoretical 11.75%). The structure is confirmed by NMR analysis.

EXAMPLE 10

Method for Preparing the tri(N-hexylamide) of 2-oxabutane-1,3,4-tricarboxylic acid To 0.3 mole (30.3 gm) of n-hexylamine is added dropwise 0.1 mole (23.4 gm) of the trimethyl ester of 2-oxabutane-1,3,4-tricarboxylic acid with vigorous stirring. During the addition, the temperature rises slowly to 50° C. The mixture is held for 4 hours at 60° C, with stirring, forming a solid product. The product is dissolved in 1500 ml acetone, chilled in an ice bath, collected on a filter, and washed thoroughly with cold acetone, then dried to constant weight. The dry product melts at 101°–103° C and has a nitrogen content of 9.4% (theoretical 9.52%). The structure is confirmed by NMR analysis.

EXAMPLE 11

Method for Preparing the tri(N-octylamide) of 2-oxabutane-1,3,4-tricarboxylic acid To 0.3 mole (38.7 gm) of n-octylamine is added dropwise 0.1 mole (23.4 gm) of the trimethyl ester of 2-oxabutane-1,3,4-tricarboxylic acid with vigorous stirring. During the addition, the temperature rises to 50° C. The mixture is held for 4 hours at 80° C with stirring, forming a solid product. Two crystallizations from acetone and drying to constant weight in vacuo at 40°–50° C yields a product having a melting point of 100°–103° C, and a nitrogen content of 7.8% (theoretical 8.0). The structure is confirmed by NMR analysis.

EXAMPLE 12

Method for Preparing the tri(N-decylamide) of 2-oxabutane-1,3,4-tricarboxylic acid To 0.3 mole (47 gm) of n-decylamine is added dropwise 0.1 mole (23.4 gm) of the trimethyl ester of 2-oxabutane-1,3,4-tricarboxylic acid with vigorous stirring. During the addition, the temperature rises to 60° C. The mixture is held at 90° C for three hours, with stirring, to form a solid product. The product is crystallized from a mixture of 700 ml acetone and 70 ml of specially denatured alcohol 3A, and then twice recrystallized from a mixture of 600 ml acetone and 80 ml of specially denatured alcohol. The product is dried in vacuo at 40°–50° C to constant weight. The dry product has a melting point of 112°–113.5° C and a nitrogen content of 6.5% (theoretical 6.9%). The structure is confirmed by NMR analysis.

EXAMPLE 13

Method for Preparing the tri(N-dodecylamide) of 2-oxabutane-1,3,4-tricarboxylic acid To 0.3 mole (55.5 gm) of n-dodecylamine is added 0.1 mole (23.4 gm) of the trimethyl ester of 2-oxabutane-1,3,4-tricarboxylic acid with vigorous stirring. During the addition, the temperature is increased to 95° C and held for 3 hours at that temperature with stirring to form a solid product. The product is crystallized twice from specially denatured alcohol 3A and fried in vacuo at 40°–50° C to constant weight. The dry product has a melting point of 113.5°–114.5° C and a nitrogen content of 5.9% (theoretical 6.06%). The structure is confirmed by NMR analysis.

EXAMPLE 14

Method for Preparing the tri(N-octadecylamide) of 2-oxabutane-1,3,4-tricarboxylic acid To 0.3 mole (80.8 gm) of n-octadecylamine at a temperature of 80° C is added dropwise 0.1 mole (23.4 gm) of the trimethyl ester of 2-oxabutane-1,3,4-tricarboxylic acid, with stirring. The reaction mixture becomes pasty after about 1 hour, and the temperature is raised to 100°–110° C, and the mixing continued at that temperature for three hours. The crude product is dissolved in 700 ml of hot isopropanol and crystallization allowed to proceed at room temperature. The crystallized product is twice crystallized from isopropanol, the crystals washed with acetone, and dried in vacuo at 40°–50° C to constant weight. There is obtained a product weighing 37 gm and having a melting point of 108.5° C, and a nitrogen content of 3.98% (theoretical 4.44%).

EXAMPLE 15

One-half gram of the triamide of 2-oxabutane-1,3,4-tricarboxylic acid is dissolved in 10 ml of dimethyl sulfoxide and poured onto a cotton swatch measuring 3×3 and contained in a beaker. The dimethyl sulfoxide is evaporated, leaving a portion of the amide on the cloth to impart to the cloth a slight bodying and stiffening effect. A control cloth treated in the same manner but without the amide is not affected.

EXAMPLE 16

Cotton fabrics may be sized by the following procedure.

One-half gram of the tri(N-octadecyl amide) of 2-oxabutane-1,3,4-tricarboxylic acid is dissolved in 10 ml of hot isopropanol. A 3×3 square of cotton cloth is immersed in the solution and when thoroughly impregnated, the cloth is removed, placed in a beaker, and the beaker and cloth placed in a vacuum oven at a temperature of about 40°–50° C to evaporate the isopropanol. When the isopropanol is removed, a residue of amide remains to impart a waxy feel to the cloth. A control cloth treated in the same manner but without the amide has no waxy feel.

EXAMPLE 17

Cotton cloth is drawn through a finishing mix in a starch mangle, and dried by procedures known to the art. The finishing mix is a viscous aqueous composition comprising wheat starch, glycerol, the tri(N-nonylamide) of 2-oxabutane-1,3,4-tricarboxylic acid, and a mildew-preventing quantity of 3,4′,5-tribromosalicylanilide.

EXAMPLE 18

Cotton yarn before twisting is drawn rapidly through a molten bath of the tri(N-dodecylamide) 2-oxabutane-1,3,4-tricarboxylic acid at a temperature of 120° C. As the yarn is drawn out of the bath, the excess amide is squeezed out by means of rollers. The amide serves as a lubricant in the subsequent twisting and winding operations, to lessen friction and heat development.

If desired, the amide lubricant may be applied by hand to the twister ring, omitting the molten bath.

Having thus described the invention, various modifications within the purview thereof will occur to those skilled in the art, and the invention is to be limited only wit in the scope of the appended claims.

What is claimed is:

1. A process for sizing textile fabrics comprising applying to said fabric an amide having the molecular structure

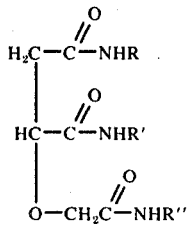

wherein R, R′, and R″, which may be the same or different, are selected from the group consisting of:

a. hydrogen, b. straight and branched chain hydrocarbon radicals having from 1 to about 18 carbon atoms, and

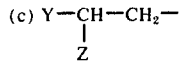

wherein Z is selected from the group consisting of H and OH and when Z is H, Y is OH or $CH_2OH$, and when Z is OH, Y is $CH_3$, and d. combinations of (a), (b) and (c).

2. A process for simultaneously sizing and lubricating cotton thread comprising applying to said thread an emulsion of starch and an amide having the structure set forth in claim 1.

* * * * *